United States Patent [19]

der Kinderen

[11] Patent Number: 4,763,494

[45] Date of Patent: Aug. 16, 1988

[54] LIQUID DISPENSING SYSTEM

[75] Inventor: Wilhelmus K. der Kinderen, Wilnis, Netherlands

[73] Assignee: Lever Brothers Company, New York, N.Y.

[21] Appl. No.: 9,077

[22] Filed: Jan. 27, 1987

Related U.S. Application Data

[63] Continuation of Ser. No. 659,148, Oct. 9, 1984, abandoned.

[30] Foreign Application Priority Data

Oct. 13, 1983 [GB] United Kingdom ..... 8327418

[51] Int. Cl.[4] ..... D06F 39/02

[52] U.S. Cl. ..... 68/17 R; 222/135; 222/651

[58] Field of Search ..... 68/17 R; 222/135, 651; 134/93, 94; 137/268; 339/58, 17 N, 94 M, 108 R, 110 P, 278 M, 119 R, 121

[56] References Cited

U.S. PATENT DOCUMENTS

| | | | |
|---|---|---|---|
| 2,539,615 | 1/1951 | Fox et al. | 222/135 |
| 2,647,526 | 8/1953 | Casady et al. | 134/94 |
| 2,762,527 | 9/1956 | Manley | 137/269 X |
| 2,802,599 | 8/1957 | Callahan et al. | 222/135 X |
| 3,015,415 | 1/1962 | Marsh et al. | 222/135 X |
| 3,153,119 | 10/1964 | Hart | 339/121 X |
| 3,398,858 | 8/1968 | Holloway | 222/135 X |
| 3,771,333 | 11/1973 | Jurjans | 222/651 X |
| 3,826,113 | 7/1974 | Noraas et al. | 68/17 R X |
| 3,843,224 | 10/1974 | Gerke, Jr. et al. | 339/58 |
| 3,999,160 | 12/1976 | McDonnell | 339/119 R X |
| 4,050,003 | 9/1977 | Owings et al. | 339/58 |
| 4,195,331 | 3/1980 | Jones | 339/110 R X |
| 4,305,633 | 12/1981 | Engberg et al. | 339/110 R X |
| 4,433,889 | 2/1984 | Ratchford | 339/94 M |

FOREIGN PATENT DOCUMENTS

| | | | |
|---|---|---|---|
| 3242411 | 5/1984 | Fed. Rep. of Germany | 68/17 R |

OTHER PUBLICATIONS

Knight Equipment Corp. "Price List".
Knight Equipment Corp. "LFS-500 Series Instruction Manual".
Knight Equipment Corp. "Peristaltic 'Prime' Rinse Injector".
Knight Equipment Corp. "Chemical Feed Systems".
Knight Equipment Corp. "Laundry Feed Systems".
Knight Equipment Corp. "Knight Equipment is . . . #1".
Beta Technologies "Series P-4000".
Beta Technologies "Series H-6000".
Beta Technologies "Series L-3000".
Beta Technologies "Series D-6300".

*Primary Examiner*—Harvey C. Hornsby
*Assistant Examiner*—Frankie L. Stinson
*Attorney, Agent, or Firm*—James J. Farrell

[57] ABSTRACT

The invention pertains to a modular liquid-dispensing system comprising modules which contain pump and electric components and a support having positions for receiving the modules; wherein the modules are positionally interchangeable on the support without interchange of function of the interchanged modules. The modular dispensing system provides a versatile liquid detergent dosing and dispensing system suitable for a wide range of washing processes, and easily adaptable to different processes or process conditions.

5 Claims, 1 Drawing Sheet

LIQUID DISPENSING SYSTEM

This is a continuation of Ser. No. 659,148, filed Oct. 9, 1984, now abandoned.

The present invention relates to liquid dispensing systems and in particular to multi-modular systems suitable for dispensing and dosing liquid detergent products.

In the field of industrial and semi-industrial cleaning liquid dispensing and dosing systems are well-known and of growing importance. Such systems comprise one or more dosing pumps, mostly of the peristaltic type, which are operated by an electrical controlling system positioned in- or outside the washing machine. Conventional dispensing systems are in general integrated pump/control systems, which are fully dedicated to the specific type of washing process they serve, the number of pumps being dependent on the number of different liquid products (detergent, bleach, conditioner etc.) which are needed in the particular washing process.

An important disadvantage of the conventional systems is that they are often difficult to adapt when changing to other types of washing processes in which a different number of liquid products are needed. Also if malfunctioning of one of the components occurs, diagnosis by the user himself is often complex or dangerous (entering in the electric system), so that a special service technician has to be called involving both time and money.

The object of the present invention therefore is to provide a versatile multimodular dispensing system which is suitable for a wide range of washing processes, both fabric and dishwashing, and which is easily adaptable to different processes and process conditions. A further object is to provide a system the maintenance of which is simple in that all modular components are easily detachable and replaceable by the user himself thus avoiding any delay in operation and hazards due to entering into the electric system.

Accordingly, the present invention provides a modular liquid-dispensing system comprising modules which contain pump and electric components, and a support having positions for receiving the modules, characterized in that the modules are positionally interchangeable on the support without interchange of function of the interchanged modules.

The dispensing system of the present invention normally comprises various types of modules which differ in function, but have substantially similar external dimensions and shapes. A first type of module has a control function and comprises electric components to operate the liquid-pumping system, i.e., to control the timing and selection of the proper product pumps and appropriate pump speeds. A second type of module has an interface function comprising components for transforming the main power supply down to correct voltage. The necessity of such module depends on the local safety regulations. A third type of module comprises a liquid pump and means for driving the pump.

The modules are detachably mounted on a support. The support by means of which the modules are attached to a surface such as one of the sides of the washing machine or a wall, is provided with means for housing electric cabling which electrically interconnects the modules.

Preferably, the support takes the form of a backplate which can be attached to a surface by conventional means. Electric connections between the modules and the electric cabling in the backplate are substantially similar for all module-receiving positions on the backplate, and should be such that each module is energized in a specific way which is the same at all module-receiving positions in the backplate.

Preferably, the electric connections in the backplate between the modules and the electric cabling system are of the multipin socket/plug type having a number of pin connections which is sufficient to allow for separate pin connections for each module. The electric cabling system is connected to the pins of each socket/plug in similar configuration.

The uniform module dimensions and similar electric connections between each module and the electric cabling in backplate provides the essential feature of the invention that all modules can be interchanged and the most suitable position of each module on the backplate can be selected.

In general it is preferred that the backplate has a girder-like structure supporting the modules side by side in a row, but if so desired the modules may also be supported by the backplate in different configurations. The number of module receiving positions on the backplate will normally equal the number of modules actually being used, but it may also be desirable that the number of positions on the supporting backplate exceeds the number of modules, thereby enabling easy extension and adaption of the number of pump modules in the case that the washing process is changed which is being operated, and a larger number of e.g. pump modules is needed. If malfunctioning of one of the components occurs, the user can disconnect the faulty module and replace it by a functioning one, a procedure providing optimal maintenance convenience. In this respect a malfunction-warning and -indication system may be of advantage.

The invention will now be further illustrated with reference to the accompanying drawings showing a preferred embodiment of the present invention.

Figure 1:
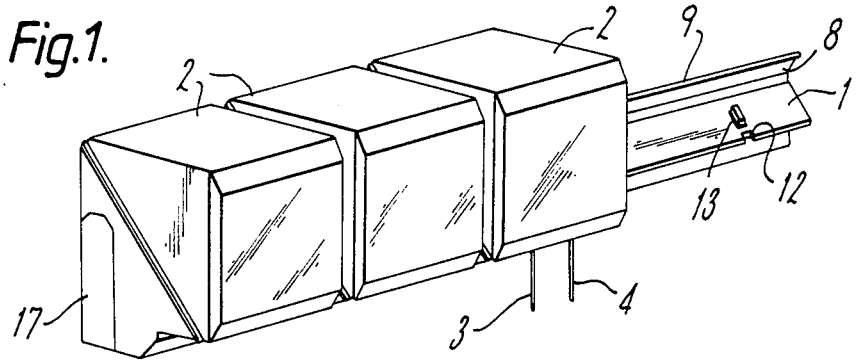
FIG. 1 is a perspective view of a five-modular dispensing system, only three of the modules being drawn.
Figure 2:
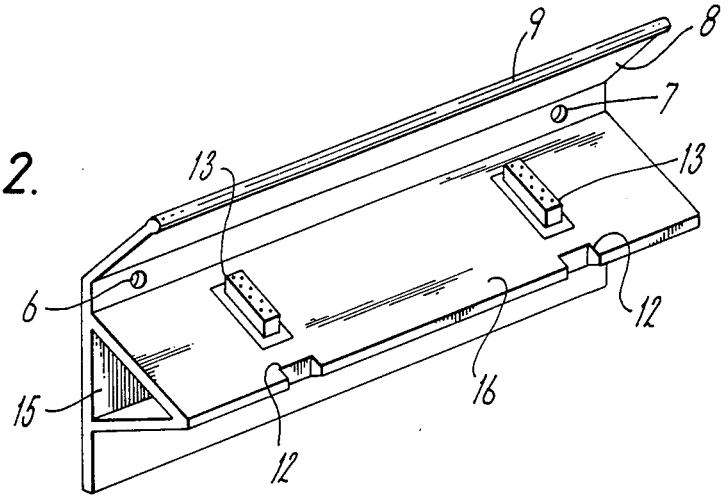
FIG. 2 is a perspective view of a supporting backplate section suitable for receiving two modules.
Figure 3:
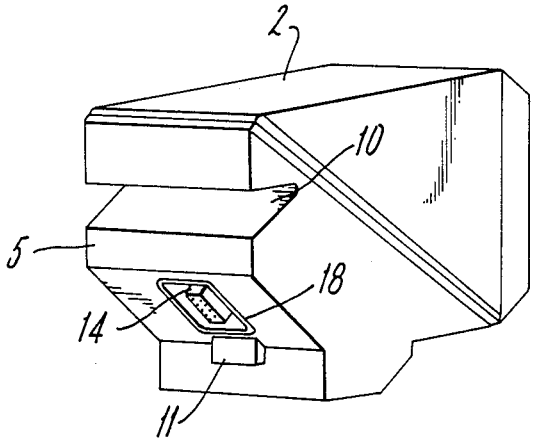
FIG. 3 is a perspective view of the rear side of a module.

The modular dosing system comprises a supporting backplate 1 which is suitable for receiving modules 2. Although, in the instant example of the preferred embodiment the backplate 1 is capable of receiving five modules, the number of module-receiving positions on the backplate is dependent on the washing process being operated and the range of washing processes adaptation to which is desired.

The embodiment as illustrated comprises a controller module, an interface module and a pump module which has tubing inlet 3 and outlet 4, extension being possible to three pump modules which then may serve a washing process using three different liquid products instead of the single product washing process which is operated by the configuration as shown.

To ensure complete physical interchangeability of the modules 2 they are similar dimensioned, but only the shape and dimension of the rear side 5 of the modules have to be identical to such detail that the modules may be attached at any receiving position of the backplate 1.

The backplate will normally be attached to a vertical surface, such as a wall, by conventional means e.g. screws through screw holes 6,7.

The shape of the backplate corresponds to and co-operates with the shapes of the rear sides of the modules. It comprises an inclined part 8 ending in a cylindrically shaped part 9 which acts as a swivel pin for easy suspension of the modules by means of a pivoting movement in a slot 10 at the modular rear side.

The projecting part 11 of the module co-operates with a corresponding notch 12 in the backplate so that the module is non-slidingly located both horizontally and vertically.

A co-operating socket/plug system 13,14 is provided which is uniform for all receiving positions and by which the electric connection between the modules and the cabling in backplate is established when the module is pivoted down into position. The electric cabling system interconnecting the modules via socket/plug connections 13,14 is incorporated in the cavity 15 inside the protruding part 16 of the backplate. Preferably the socket/plug connections are of the multi-pin type having a sufficient number of pin connections to establish complete electric interchangeability between all modules.

It is also preferred that the conduit cavity 15 is sealed in order to prevent any moisture entering the cavity. To this purpose there may be provided sealing end caps 17 at both ends of the backplate and seals 18 around sockets 13 or plugs 14.

Both the backplate and the modules may be manufactured from any suitable material, but synthetic materials are preferred, requiring a minimum of maintenance.

It is clear that to those skilled in the art to which this invention relates, many changes in construction and widely differing embodiments of the invention will suggest themselves without departing from the spirit and scope of the invention.

I claim:

1. A modular liquid dispensing system consisting essentially of one or more dosing pump modules and an electrical control system module, wherein the pump module and the control system module are each in a respective separate housing, and the dispensing system further comprises, a support provided with an electrical cabling system wired to positions on the support, each position being capable of detachably receiving any one of said modules, multi-pin socket/plug electrical connectors being provided for interconnecting said modules via the cabling system when the modules are received at respective said positions, the connectors being wired such that each module can operate in accordance with its designated function, independently of the position at which it is received on the support.

2. A dispensing system according to claim 1, wherein said cabling system is contained in a housing enabling said cabling system to be sealed from atmosphere.

3. A dispensing system according to claim 1, wherein said modules are received at said positions.

4. A dispensing system according to claim 3 wherein the number of said modules equals the number of said positions.

5. A dispensing system according to claim 3 wherein the number of said positions exceeds the number of said modules.

* * * * *